US008097387B2

(12) United States Patent
Aziz et al.

(10) Patent No.: US 8,097,387 B2
(45) Date of Patent: Jan. 17, 2012

(54) PHOTORECEPTORS COMPRISING ALIGNED NANO-SIZED DOMAINS OF CHARGE TRANSPORT COMPONENTS THAT HAVE SIGNIFICANT INTERMOLECULAR PI-PI ORBITAL OVERLAP

(75) Inventors: Hany Aziz, Oakville (CA); Kathy L. De Jong, London (CA)

(73) Assignee: Xerox Corporation, Norwalk, CT (US)

( * ) Notice: Subject to any disclaimer, the term of this patent is extended or adjusted under 35 U.S.C. 154(b) by 777 days.

(21) Appl. No.: 12/243,400

(22) Filed: Oct. 1, 2008

(65) Prior Publication Data

US 2009/0226829 A1 Sep. 10, 2009

Related U.S. Application Data

(60) Provisional application No. 61/034,716, filed on Mar. 7, 2008.

(51) Int. Cl.
*G03G 15/00* (2006.01)

(52) U.S. Cl. ..... 430/58.15; 430/58.5; 430/48

(58) Field of Classification Search ..... 430/58.1, 430/58.5, 48
See application file for complete search history.

(56) References Cited

U.S. PATENT DOCUMENTS 5,843,607 A * 12/1998 Hu et al. ..... 430/58.5
2008/0138725 A1* 6/2008 Fujiwara et al. ..... 430/48

OTHER PUBLICATIONS

Weidkamp, et al., "A Photopatternable Pentacene Precursor for Use in Organic Thin-Film Transistors," *Journal of American Chemical Society*, 126, 12740-12741, (2004).
Eichhorn, et al., "Alignment of Discotic Liquid Crystals," *Molecular Crystal Liquid Crystal*, vol. 397, pp. 47-58, (2003).
Eichhorn, et al., "Star-shaped heptamers of discotic dyes as new materials for photovoltaic devices", *Material Research Society Symposium Proc.*, vol. 836, pp. L4.6.1-L4.6.3, (2005).

* cited by examiner

*Primary Examiner* — Mark F Huff
*Assistant Examiner* — Rashid Alam
(74) *Attorney, Agent, or Firm* — Oliff & Berridge, PLC

(57) ABSTRACT

Described herein are photoreceptor devices that include aligned domains of charge transport materials that have a pi-pi orbital overlap.

20 Claims, No Drawings

PHOTORECEPTORS COMPRISING ALIGNED NANO-SIZED DOMAINS OF CHARGE TRANSPORT COMPONENTS THAT HAVE SIGNIFICANT INTERMOLECULAR PI-PI ORBITAL OVERLAP

This nonprovisional application claims the benefit of U.S. Provisional Application No. 61/034,716, filed Mar. 7, 2008.

BACKGROUND

Described herein are photosensitive members, that is, photoreceptor devices, that include aligned domains of charge transport materials having a pi-pi orbital overlap.

Photosensitive members such as electrophotographic or photoconductive imaging members, including photoreceptors or photoconductors, typically include a photoconductive layer formed on an electrically conductive substrate or formed on layers between the substrate and a photoconductive layer. The photoconductive layer is an insulator in the dark, so that electric charges are retained on its surface. Upon exposure to light, the charge is dissipated, and an image may be formed thereon, developed using a developer material, transferred to a copy substrate, and fused thereto to form a copy or print.

Known organic photoreceptors use polymer binders as a holding media for functional materials, such as charge generating materials and/or charge transport materials. In such known photoreceptors, the charge transport materials may be arranged in a highly disordered state. Unfortunately, when the charge transport materials are arranged in a disordered state in a binder, increasing the charge mobility beyond the current values is not readily achievable.

Thus, it is still desired to produce photoreceptors having a controlled and ordered morphology of charge transport materials such that the charge mobility of the photoreceptor devices may be increased.

SUMMARY

In embodiments, described herein is a photoreceptor device, comprising at least a substrate, a charge generating layer, and a charge transport layer having charge transport materials, wherein the charge transport materials are arranged such that intermolecular spacings allow for pi-pi stacking to be formed.

In further embodiments, described herein is a photoreceptor device, comprising at least a substrate, and a single layer including charge transport materials and charge generating materials, wherein the charge transport materials are arranged such that intermolecular spacings form pi-pi stacking.

EMBODIMENTS

An electrophotographic imaging member, for example, a photoreceptor, may be provided with an anti-curl layer, a supporting substrate, an electrically conductive ground plane, a charge blocking layer, an adhesive layer, a charge generating layer, a charge transport layer, an overcoat layer, and a ground strip. A layered imaging zone is generally depicted as two layers, one being a charge generating layer and the other being a charge transport layer. In alternative embodiments, the layered imaging zone may be a single layer containing both charge generating material and charge transport material, and may take the place of a layered imaging zone having a separate charge generating layer and charge transport layer.

In fabricating a photoreceptor, a charge generating material and a charge transport material may be deposited onto the substrate surface either in a laminate type configuration where the charge generating material and charge transport material are in different layers or in a single layer configuration where the charge generating material and charge transport material are in the same layer along with a binder resin. The photoreceptors may be prepared by applying over the electrically conductive layer the charge generation layer and, optionally, a charge transport layer. In embodiments, the charge generation layer and, when present, the charge transport layer, may be applied in either order.

Anti-Curl Layer

For some applications, an optional anti-curl layer may be provided, which comprises film-forming organic or inorganic polymers that are electrically insulating or slightly semiconductive. The anti-curl layer provides flatness and/or abrasion resistance.

The anti-curl layer may be formed at the back side of the substrate, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer. Representative additives include organic and inorganic particles which may further improve the wear resistance and/or provide charge relaxation property. Representative organic particles include Teflon powder, carbon black, and graphite particles. Representative inorganic particles include insulating and semiconducting metal oxide particles such as silica, zinc oxide, tin oxide and the like. Another semiconducting additive is the oxidized oligomer salts, such as N,N,N',N'-tetra-p-tolyl-4,4'-biphenyldiamine salt.

Typical adhesion promoters useful as additives include DUPONT 49,000 (available from E. I. duPont de Nemours & Co), VITEL PE-100, VITEL PE-200, VITEL PE-307 (available from Goodyear Tire and Rubber Co.), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers such as from about 5 micrometers to about 25 micrometers or about 14 micrometers.

The anti-curl coating may be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer may be accomplished simultaneously by web coating onto a multilayer photoreceptor comprising a charge transport layer, charge Generation layer, adhesive layer, blocking layer, ground plane and substrate. The wet film coating is then dried to produce the anti-curl layer.

Substrate

As indicated above, the photoreceptors are prepared by first providing a substrate, that is, a support. The substrate may be opaque or substantially transparent and may comprise any of numerous suitable materials having given required mechanical properties.

The substrate may comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate may be flexible or rigid and may have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins may be used as electrically non-conducting materials, including, for example polyesters, polycarbonates, polyamides, polyurethanes, and the like. Such a substrate may comprise a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor may also be coated on an insulating plastic drum, provided a conducting ground plane has previously been coated on its surface, as described above. Such substrates may either be seamed or seamless.

When a conductive substrate is employed, any suitable conductive material may be used. For example, the conductive material may include metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum may be used, as well as a conducting metal drum made from a material such as aluminum.

The thickness of the substrate depends on numerous factors, including the required mechanical performance and economic considerations. The thickness of the substrate is typically within a range of from about 65 micrometers to about 150 micrometers, such as from about 70 micrometers to about 135 micrometers or from about 75 micrometers to about 125 micrometers for optimum flexibility and minimum induced surface bending stress when cycled around small diameter rollers, for example, 19 mm diameter rollers. The substrate for a flexible belt may be of a thickness, for example, of from about 50 micrometers to about 200 micrometers, provided there are no adverse effects on the final photoconductive device. Where a drum is used, the thickness should be sufficient to provide the necessary rigidity. This is usually from about 1 mm to about 6 mm.

The surface of the substrate to which a layer is to be applied may be cleaned to promote greater adhesion of such a layer. Cleaning may be effected, for example, by exposing the surface of the substrate layer to plasma discharge, ion bombardment, and the like. Other methods, such as solvent cleaning, may be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

Electrically Conductive Ground Plane

The present photoreceptors comprise a substrate that is either electrically conductive or electrically non-conductive. When a non-conductive substrate is employed, an electrically conductive ground plane is generally employed, and the ground plane acts as the conductive layer. When a conductive substrate is employed, the substrate may act as the conductive layer, although a conductive ground plane may also be provided.

If an electrically conductive ground plane is used, it is positioned over the substrate. Suitable materials for the electrically conductive ground plane include, for example, aluminum, zirconium, niobium, tantalum, vanadium, hafnium, titanium, nickel, stainless steel, chromium, tungsten, molybdenum, copper, and the like, and mixtures and alloys thereof. In embodiments, the material for the electrically conductive ground plane is selected from aluminum, titanium, and zirconium.

The ground plane may be applied by known coating techniques, such as solution coating, vapor deposition, and sputtering. One method of applying an electrically conductive ground plane is by vacuum deposition. Other suitable methods may also be used.

Thicknesses of the ground plane may be within a substantially wide range, depending on the optical transparency and flexibility desired for the electrophotoconductive member. Accordingly, for a flexible photoresponsive imaging device, the thickness of the conductive layer is, for example, from about 20 angstroms to about 750 angstroms, such as from about 50 angstroms to about 200 angstroms depending on the desired combination of electrical conductivity, flexibility, and light transmission. However, the ground plane may, if desired, be opaque.

Charge Blocking Layer

After deposition of any electrically conductive ground plane layer, an optional charge blocking layer may be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized.

If a blocking layer is employed, it is typically positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer may include polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl)titanate, isopropyl di(4-aminobenzoyl)isostearoyl titanate, isopropyl tri(N-ethyl amino)titanate, isopropyl trianthranil titanate, isopropyl tri(N,N-dimethyl-ethyl amino)titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane.

A representative hole blocking layer comprises a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes may then be used as is well known in the art.

The blocking layer is continuous and may have a thickness of up to 2 micrometers depending on the type of material used.

However, the blocking layer in embodiments has a thickness of less than about 0.5 micrometer because greater thicknesses may lead to undesirably high residual voltage. For example, a suitable blocking layer described herein may have a thickness of from about 0.005 micrometer to about 0.3 micrometer, such as from about 0.03 micrometer to about 0.06 micrometer, which is satisfactory for most applications because charge neutralization after the exposure step is facilitated and good electrical performance is achieved.

The blocking layer may be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as by vacuum, heating, and the like. Generally, a weight ratio of blocking layer material and solvent of from about 0.5:100 to about 5.0:100 is satisfactory for spray coating.

Adhesive Layer

An intermediate layer between the blocking layer and the charge generating layer may optionally be provided to promote adhesion. However, in embodiments, a dip coated drum may be utilized without an adhesive layer.

Additionally, adhesive layers may be provided, if necessary, between any of the layers in the photoreceptors to ensure adhesion of any adjacent layers. Alternatively, or in addition, adhesive material may be incorporated into one or both of the respective layers to be adhered. Such optional adhesive layers may have a thickness of from about 0.001 micrometer to about 0.2 micrometer. Such an adhesive layer may be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, DUPONT 49,000 (available from E. I. duPont de Nemours & Co.), VITEL PE-100 (available from Goodyear Tire and Rubber Co.), polyvinyl butyral, polyvinyl pyrrolidone, polytrethane, polymethyl methacrylate, and the like. The adhesive layer may be composed of a polyester with a $M_w$ of from about 50,000 to about 100,000, such as about 70,000, and a $M_n$ of from about 15,000 to about 50,000, such as about 35,000.

Imaging Zone

The imaging zone refers to a layer or layers comprising charge generating material, charge transport material, or both the charge generating material and the charge transport material, and an optional binder. The charge generating material may be present in a charge generation layer, while the charge transport material may be present in a charge transport layer. In alternative embodiments, the charge generating material and the charge transport material may be present in one single layer.

Either a negative type or a positive type charge generating material may be employed in the present photoreceptor.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, aluminochloro-phthalocyanine, hydroxygallium phthalocyanine, titanyl phthalocyanine, metal-free phthalocyanine and the like; quinacridone pigments; or azulene compounds. Suitable inorganic photoconductive charge generating materials include, for example, cadium sulfide, cadmium sulfoselenide, cadmium selenide, crystalline and amorphous selenium, lead oxide and other chalcogenides. Alloys of selenium are encompassed by embodiments of the present disclosure and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent may be, for example, cyclohexanone, methyl ethyl ketone, tetrahydrofuran, alkyl acetate, and mixtures thereof. The alkyl acetate (such as butyl acetate and amyl acetate) may have from 3 to 5 carbon atoms in the alkyl group. The amount of solvent in the coating composition ranges for example from about 70 weight percent to about 98 weight percent, based on the weight of the coating composition.

The amount of the charge generating material in the composition ranges, for example, from about 0.5 weight percent to about 30 weight percent, based on the weight of the composition including a solvent. The amount of photoconductive particles, that is, the amount of charge generating material, dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results may be achieved with an average photoconductive particle size of less than about 0.6 micrometer when the photoconductive coating is applied by dip coating. In embodiments, the average photoconductive particle size is less than about 0.4 micrometer. Typically, the photoconductive particle size is also less than the thickness of the dried photoconductive coating in which it is dispersed.

In a charge generating layer, the weight ratio of the charge generating material (CGM) to the binder ranges for example from 30 (CGM):70 (binder) to 70 (CGM):30 (binder).

For multilayered photoreceptors comprising a charge generating layer (also referred herein as a photoconductive layer) and a charge transport layer, satisfactory results may be achieved with a dried photoconductive layer coating thickness of from about 0.1 micrometer to about 10 micrometers, such as from about 0.2 micrometer to about 4 micrometers. However, these thicknesses also depend upon the pigment loading. Thus, higher pigment loadings permit the use of thinner photoconductive coatings.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is from about 4 days to about 6 days.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. The charge transport material disclosed herein is characterized by small intermolecular spacings allowing pi-pi stacking between molecules. For charge transport materials, intermolecular pi-pi stacking provides high efficiency charge mobilities across the crystal domain. A domain is an area within a material with a high level of ordering.

The photoreceptors described herein include nano-sized domains of charge transport components in which intermolecular spacing is small enough, for example, greater than about 0 but less than about 5 nm, such as less than about 1 nm or less than about 5 Å, to allow sufficient intermolecular pi-pi stacking. Typically, the charge transport materials are electron donating or accepting moieties for hole or electron transport materials, respectively, on small molecule, oligomer or polymer materials. The close molecular packing within the domains allows strong intermolecular pi-pi interaction that leads to significantly higher charge carrier mobility. Typically, a domain contains at least 5 such moieties, that is, at least 5 moieties with overlapping pi-pi orbital system. Also, a domain size is in the range of from about 2 nm to about 2000 nm along some characteristic dimension, for example, the diameter for spherical domains, diameter or length for columnar domains, etc. The nano-sized domains are aligned together such that the vector sum of the individual domain directors is within about 45 degrees, such as within about 30 degrees, from a normal line of the photoreceptor substrate.

Charge transport materials that are suitable herein are typically organic, oligomeric or polymeric molecules that have (i) an affinity to self assemble and self organize along a direction (director) that is ideally normal to (such as within 45 degrees of the normal) the layer in which they are present (in this case, normal to both the CTL and the substrate of the photoreceptor device), (ii) an affinity for close molecular packing driven by an affinity for pi-pi stacking, and (iii) are soluble enough to allow fabrication via solution coating processes commonly used for organic photoreceptors.

One example of such materials are certain classes of materials with liquid crystal bahavior, for example, discotic liquid crystals, such as, fused ring aromatic hydrocarbon components, p-type fused ring hetero-aromatic components, n-type fused ring hetero-aromatic components, triphenyl-based, coronene-based and phthalocyanine-based derivatives, and mixtures thereof, capable of forming classy domains of aligned columnar stacks in the solid state. As used herein, the term "hetero-aromatic" components refers to an aryl group containing a hetero-atom. Other known materials that favor strong intermolecular pi-pi stacking include fused ring systems, such as pentacene, tetracene and anthracene derivatives. Derivatives described herein refer to a compound comprising a core component comprised of the fused ring systems, and a substituent comprised of, for example, an alkyl having from 1 to 50 carbon atoms, such as from about 3 to about 25 carbon atoms, an alkylaryl having from about 5 carbon atoms to about 50 carbon atoms, such as from about 8 to about 30 carbon atoms, or an alkoxy having from about 3 carbon atoms to about 50 carbon atoms about 6 to about 30 carbon atoms. Although historically these materials have generally been known to have little solubility, because of their strong affinity to aggregate, recent advances have led to the development of soluble precursors that would allow them to lend themselves easily to solution coating. Certain classes of triazines and indolocarbazoles are also known to have the desired properties, and may also be suitable. See, for example, Weidkamp et al, JACS, 126, 12741 (2004), which is incorporated herein in its entirety by reference.

Another class of suitable materials includes star-shaped hetero-heptamers of positive type and negative type discotic dyes, such as, for example, hole conducting heptamers of the following structure:

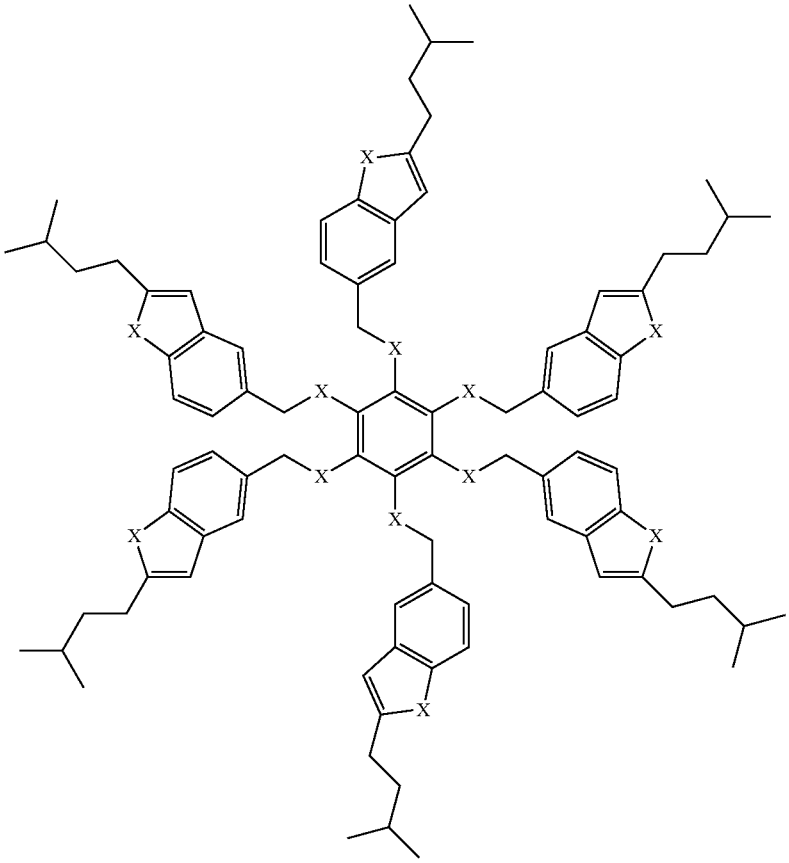

where X is —S, —Se, —O or —NR, where R is an alkyl or aryl having from 1 to about 20 carbon atoms, such as from 1 to about 18 carbon atoms or from about 1 to about 15 carbon atoms. Also suitable are charge transport materials that are mixtures of any suitable material described herein.

Illustrative charge transport materials suitable for use herein further include a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; clrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene) and poly(vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile. Other hole transporting materials include arylamines, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights may vary from about 20,000 to about 1,500,000.

In a charge transport layer, the weight ratio of the charge transport material (CTM) to the binder ranges for example from 30 (CTM):70 (binder) to 70 (CTM):30 (binder).

It is possible that the charge transport layer will be composed almost entirely of the charge transport material. However, in order to improve the mechanical robustness of the photoreceptor, the charge transport material is often mixed with another material, usually a polymer, where the latter functions as a binder. In this case, it is desirable to have the charge transport domains attain certain distributions in the binder that facilitates direct domain-to-domain charge transport across the charge transport layer by increasing domain-to-domain proximity and minimizing inter-domain interruptions. For example, the domains that are aligned such that the vector sum of the individual domain directors is withing 45 degrees from the normal to the photoreceptor substrate form high mobility paths across the charge transport layer. Such organization of domains may be induced, for example, by using known molecular self assembly processes as described herein. In such cases, when the charge transport domains organize in column-like morphologies, the spacing in-between the different "columns" should be less than 10 microns, such as less than 5 microns or less than 3 microns, in the interest of high image resolution.

Any suitable technique may be utilized to apply the charge transport layer and the charge generating layer to the substrate. In embodiments, where the charge transport material and the charge generating material are present in one layer, then that layer having both functional materials may be applied to the substrate by any suitable technique. Typical coating techniques include dip coating, roll coating, spray coating, rotary atomizers, and the like. The coating techniques may use a wide concentration of solids. In embodiments, the solids content is from about 2 percent by weight to about 30 percent by weight based on the total weight of the dispersion. The expression "solids" refers to the photoconductive pigment particles and binder components of the charge generating coating dispersion and to the charge transport particles and binder components of the charge transport coating dispersion. These solids concentrations are useful in dip coating, roll, spray coating, and the like. Generally, a more concentrated coating dispersion is present for roll coating. Drying of the deposited coating may be effected by any suitable conventional technique such as oven drying, infrared radiation drying, air drying and the like. Generally, the thickness of the charge generating layer ranges for example from about 0.1 micrometer to about 3 micrometers and the thickness of the transport layer may be from about 5 micrometers to about 100 micrometers. In general, the ratio of the thickness of the charge transport layer to the charge generating layer may be from about 2:1 to about 200:1, and in some instances may be as great as about 400:1.

The materials and procedures described herein may be used to fabricate a single imaging layer type photoreceptor containing a binder, a charge generating material, and a charge transport material. For example, the solids content in the dispersion for the single imaging layer may range from about 2 weight percent to about 30 weight percent, based on the weight of the dispersion.

Where the imaging layer is a single layer combining the functions of the charge generating layer and the charge transport layer, illustrative amounts of the components contained therein are as follows: charge generating material (from about 5 weight percent to about 40 weight percent), charge transport material (from about 20 weight percent to about 60 weight percent), and binder (the balance of the imaging layer).

The photoreceptor may optionally include a patterned binder layer. The patterned binder may be formed by means of any molecular self-assembly process. The self-assembled patterned binder may be used as the binder in any layer of the photoreceptor layers. For example, the self-assembled patterned binder layer may be used as the binder layer in one or more, or even all, of the layers in a photoreceptor device, such as, for example, in (i) a charge generation and transport layer, (ii) a charge generation layer, (iii) a charge transport layer, (iv) an overcoat layer or (v) an undercoat layer. The patterned binder layer may have any kind of symmetry, that is, one dimensional, two dimensional or three dimensional symmetry, in any direction such as parallel to the layer, perpendicular to the layer, and the like. Although the pattern periodicity may be of any size possible by formation of molecular self-assembly, the periodicity of the patterned binder layer may be less than about 500 μm, parallel to a substrate, in the interest of increased image resolution.

The self-assembled binder layer may have hollow spaces, such as holes, spheres, ridges, channels and columns. For purposes herein, the hollow spaces will be universally referred to as "pores." If the pores are circular or spherical in nature, then they may have a diameter of from about 1 nm to about 100 μm, such as a diameter from about 10 nm to about 50 μm or from about 100 nm to about 10 μm. The binder material suitable for forming the self-assembled patterned binder layer may be comprised of any polymeric, oligomeric or small-molecule organic material. Suitable examples of such binder materials include polycarbonates and polystyrenes. Self-assembled patterned binder layers may produce a patterned film such that different functional materials may be confined to a particular location and in a particular spatial arrangement. For example, a binder which self-assembles to form dispersed spaces may allow confinement of charge transport molecules to discrete locations evenly dispersed throughout the photoreceptor device, promote molecular assembly of the functional material within these spaces, and ultimately result in a faster discharge.

The size of a polymer binder, such as a molecular weight (Mw) of from about 2,000 to about 600,000, and the physical arrangement or patterning of the material, such as a honeycomb pattern, may improve the mechanical properties of any layer within the device.

Examples of a process that may lead to a self-assembled porous binder matrix involve utilizing a polymer, a solvent, and a non-solvent. One of ordinary skill may refer to such a method as the "breath figure" method. Suitable polymers for forming binder layers according to the "breath figure" method may include any polymers that form star-like micelles, for example linear polymers such as monocarboxy terminated polystyrene, dicarboxy terminated polystyrene, polyamide, and mixtures thereof; and branched polymers, any block copolymer, for example including block copolymers with at least one material (block) being a polystyrene, a poly(paraphenylene) or a polyimide, such as a material selected from polystyrene, polyparaphenylene, poly-2-vinylpyridine, poly(n-alkylmethacrylate), poly(n-butylmethacrylate), poly(methyl methacrylate), poly(2-vinylpyridine), polyisoprene, poly(ferrocenyldimethylsilane), poly (cyclohaylethylene), polylactide, poly (ferrocenyldimethylsilane), poly(dimethlysiloxane), poly (ethylene-propylene), polyethylene, polybutadiene, poly (ethyleneoxide), polystyrenepolybutadiene, poly(α-methylstyrene), poly(4-hydroxystyrene), poly (methyltetraclododecene), poly(substituted-2-norbornene), poly(propyleneoxide), poly(butadienevinylpyridinium), poly (tert-butylacrylate), poly(cinnamoyl-ethylmethacrylate), pentadecyl phenol modified polystyrene, poly(4-vinylpyridine) and poly(tert-butylmethacrylate). Specific examples of block copolymers include polystyrene-polyparaphenylene block copolymers, polystyrene/poly-2-vinylpyridine, and the block copolymers selected from polystyrene/poly(n-alkylmethacrylate), polystyrene/poly(n-butylmethacrylate), polystyrene/poly(methyl methacrylate), polystyrene/poly(2-vinylpyridine), polystyrene/polyisoprene polystyrene/poly (ferrocenyldimethylsilane), poly(cyclohexylethylene)/polylactide, poly(ferrocenyldimethylsilane)/poly (dimethylsiloxane), polystyrene/poly(ethylene-propylene), polyestyrene/polyethylene, polybutadiene/poly(ethyleneoxide), polystyrene/polybutadiene, polystyrene/poly(ethyleneoxide), polystyrenepolybutadiene/polystyrene, poly(α-methylstyrene)/poly(4-hydroxystyrene), polyisoprene/poly (ferrocenyldimetliylsilane), polystyrene/polyisoprene/polystyrene, polystyrene/poly(tert-butylacrylate), poly (methyltetracyclododecene)/poly(substituted-2-norbornene), polyisoprene/poly(etliyleneoxide), polystyrene/polylactide, poly(ethyleneoxide)/poly(propyleneoxide)/poly(ethyleneoxide), polybutadiene/poly(butadienevinylpyridinium), poly(tert-butylacrylate)/poly(cinnamoyl-ethylmethacrylate), pentadecyl phenol modified polystyrene/poly(4-vinylpyridine), polystyrene/poly(2-vinylpyridine)/poly(tert-butylmethacrylate), polystyrene/poly (paraphenylene), and combinations thereof.

To prepare binder layers by the "breath figure" method, polymer/solvent solutions may be spread onto a flat support and rapidly evaporated by a flow of humid air. The flat support may be in an environment having a non-solvent, for example, a humid environment, such as an enclosed humid chamber, and an inert gas, such as air, xenon, argon, nitrogen, oxygen, and the like, is optionally passed over the flat support having the polymer/solvent solution thereon. Use of an inert gas is not necessary if the boiling point of the solvent is such that it will evaporate without the use of an inert gas.

Evaporation of the solvent, and the subsequent cooling of the solution surface induces non-solvent vapor condensation, such as water vapor condensation, in droplets at the air/solution interface with the majority of the non-solvent droplets located below the air/solution interface. Precipitation of the polymer at the solution/non-solvent interface may form a solid polymer layer surrounding the non-solvent droplet preventing coalescence with other non-solvent droplets. Such an encapsulation may allow locally arranged droplets to form stable compact hexagonal geometries producing films with a "honeycomb" appearance.

Following the solvent evaporation, due to the majority of the non-solvent droplet being below the surface, water evaporation bursts the polymer layer on top of the droplets and may thus generate the pores.

The alignment of the domains of the charge transport material allows strong intermolecular pi-pi interaction that leads to significantly higher charge carrier mobility. The ability to move holes or electrons with higher efficiency leads to faster discharge photoreceptors.

Overcoat Layer

The photoreceptor may further optionally include an overcoat layer or layers, which, if employed, are positioned over the charge generation layer or over the charge transport layer. This layer comprises organic polymers or inorganic polymers that are electrically insulating or slightly semi-conductive.

Such a protective overcoat layer includes a film forming resin binder (referred to as binder or resin binder) optionally doped with a charge transport material.

Any suitable film-forming inactive resin binder may be employed in the overcoat layer. For example, the film forming binder may be any suitable resin, such as polycarbonate, polyarylate, polystyrene, polysulfone, polyphenylene sulfide, polyetherimide, polyphenylene vinylene, and polyacrylate. The resin binder used in the overcoat layer may be the same or different from the binder used in the anti-curl layer or in the layered imaging zone. In embodiments, the binder resin has a Young's modulus greater than about $2\times10^5$ psi, a break elongation no less than about 10%, and a glass transition temperature greater than about 150° C. The binder may further be a blend of binders. Representative polymeric film forming binders include MAKROLON™, a polycarbonate resin having a weight average molecular weight of from about 50,000 to about 100,000 available from Farbenfabriken Bayer A. G., 4,4'-cyclohexylidene diphenyl polycarbonate, available from Mitsubishi Chemicals, high molecular weight LEXAN™ 135, available from the General Electric Company, ARDEL™ polyarylate D-100, available from Union Carbide, and polymer blends of MAKROLON™ and the copolyester VITEL™ PE-100 or VITEL™ PE-200, available from Goodyear Tire and Rubber Co.

In embodiments, a range of from about 1 weight percent to about 10 weight percent, such as from about 3 weight percent to about 7 weight percent, of the overcoat layer of VITEL™ copolymer may be used in blending compositions. Other polymers may be used as resins in the overcoat layer, such as DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoat layer in the range of, for example, about 0.5 to about 40 weight percent of the overcoat layer. Representative additives include organic and inorganic particles, which may further improve the wear resistance and/or provide charge relaxation property. Representative organic particles include Teflon powder, carbon black, and graphite particles. Representative inorganic particles include insulating and semiconducting metal oxide particles such as silica, zinc oxide, tin oxide and the like. Another semiconducting additive is the oxidized oligomer salts as described in U.S. Pat. No. 5,853,906. Representative oligomer salts are oxidized N,N,N',N'-tetra-p-tolyl-4,4'-biphenyldiamine salt.

The overcoat layer may be prepared by any suitable conventional technique and applied by any of a number of application methods. Typical application methods include, for example, hand coating, spray coating, web coating, dip coating and the like. Drying of the deposited coating may be effected by any suitable conventional techniques, such as oven drying, infrared radiation drying, air drying, and the like.

Overcoats of from about 3 micrometers to about 7 micrometers, such as from about 3 micrometers to about 5 micrometers, may be effective in preventing charge transport molecule leaching, crystallization, and charge transport layer cracking.

Ground Strip

A ground strip suitable for use herein may comprise a film-forming binder and electrically conductive particles. Cellulose may be used to disperse the conductive particles. Any suitable electrically conductive particles may be used in the electrically conductive ground strip layer. Typical electrically conductive particles include carbon black, graphite, copper, silver, gold, nickel, tantalum, chromium, zirconium, vanadium, niobium, indium tin oxide, and the like.

The electrically conductive particles may have any suitable shape. Typical shapes include irregular, granular, spherical, elliptical, cubic, flake, filament, and the like. In embodiments, the electrically conductive particles have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers, such as from about 14 micrometers to about 27 micrometers.

Since the layered imaging zone is continuous across the image bearing region of the photoreceptor, the present photoreceptor avoids switching elements that are formed on the surface of the image bearing member.

Embodiments described above will now be further illustrated by way of the following examples.

It will be appreciated that various of the above-disclosed and other features and functions, or alternatives thereof may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A photoreceptor device, comprising:

at least a substrate; a charge generating layer; and a charge transport layer having charge transport materials, wherein the charge transport materials are discotic liquid crystals selected from the group consisting of fused ring aromatic hydrocarbon components, p-type fused ring hetero-aromatic components, n-type fused ring hetero-aromatic components, and mixtures thereof wherein the charge transport materials include:

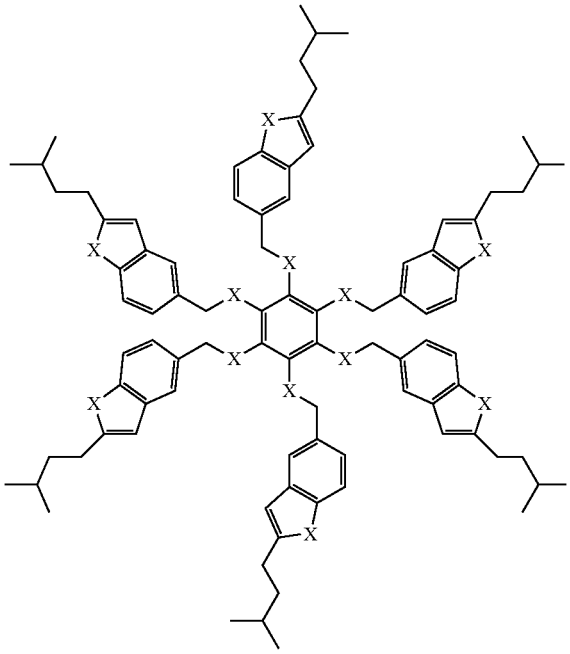

where X is —S. —Se, —O, or —NR, where R is an alkyl or aryl having from 1 to about 20 carbon atoms.

2. The photoreceptor device according to claim 1, wherein the charge transport materials are arranged such that intermolecular spacings form pi-pi stacking.

3. The photoreceptor device according to claim 1, wherein the pi-pi stacking forms domains where the charge transport materials are highly ordered such that the domains are aligned together in a manner where a vector sum of individual domain directors is within about 45 degrees from a normal line to the substrate.

4. The photoreceptor device according to claim 3, wherein the vector sum of the individual domain directors is within about 30 degrees from a normal line to the substrate.

5. The photoreceptor device according to claim 3, wherein the vector sum of the individual domain directors is perpendicular to the substrate.

6. The photoreceptor device according to claim 1, wherein the intermolecular spacings are from more than about 0 to about 5 nm.

7. The photoreceptor device according to claim 6, wherein the intermolecular spacings are less than about 5 Å.

8. The photoreceptor device according to claim 1, wherein the charge transport materials are selected from the group consisting of polycyclic aromatic ring, a nitrogen-containing hetero ring, triazines, indolocarbazoles, carbazole, N-ethyl carbazole, N-isopropyl carbazole, N-phenyl carbazole, tetraphenylpyrene, 1-methyl pyrene, perylene, chrysene, anthracene, tetraphene, 2-phenyl naphthalene, azopyrene, 1-ethyl pyrene, acetyl pyrene, 2,3-benzoclirysene, 2,4-benzopyrene, 1,4-bromopyrene, poly(N-vinylcarbazole), poly (vinylpyrene), poly(vinyltetraphene), poly(vinyltetracene), poly(vinylperylene), 2,4,7-trinitro-9-fluorenone, 2,4,5,7-tetranitro-fluorenone, dinitroanthracene, dinitroacridene, tetracyanopyrene, dinitroanthraquinone, butylcarbonylfluorenemalononitrile, arylamines, and mixtures thereof.

9. The photoreceptor device according to claim 1, wherein the charge transport layer further includes a binder.

10. The photoreceptor device according to claim 9, wherein the binder is capable of forming a self-assembled patterned layer.

11. A photoreceptor device, comprising:

at least a substrate; and a single layer including charge transport materials and charge generating materials, wherein the charge transport materials are discotic liquid crystals selected from the group consisting of fused ring aromatic hydrocarbon components, p-type fused ring hetero-aromatic components, n-type fused ring hetero-aromatic components, and mixtures thereof wherein the charge transport materials include:

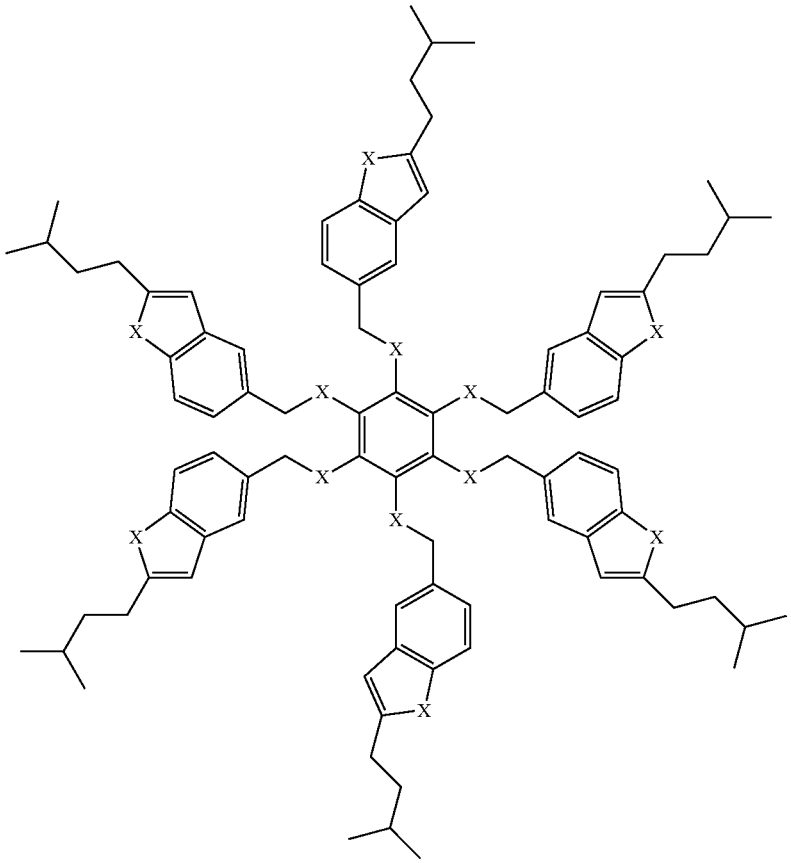

where X is —S. —Se, —O, or —NR, where R is an alkyl or aryl having from 1 to about 20 carbon atoms.

12. The photoreceptor device according to claim 11, wherein the charge transport materials are arranged such that intermolecular spacings form pi-pi stacking.

13. The photoreceptor device according to claim 11, wherein the pi-pi stacking forms domains where the charge transport materials are highly ordered such that the domains are aligned together in a manner where a vector sum of individual domain directors is within about 45 degrees from a normal line to the substrate.

14. The photoreceptor device according to claim 13, wherein the vector sum of the individual domain directors is within about 30 degrees from a normal line to the substrate.

15. The photoreceptor device according to claim 13, wherein the vector sum of the individual domain directors is perpendicular to the substrate.

16. The photoreceptor device according to claim 11, wherein the intermolecular spacings are from more than about 0 to about 5 nm.

17. The photoreceptor device according to claim 16, wherein the intermolecular spacings are less than about 5 Å.

18. The photoreceptor device according to claim 11, wherein the charge transport materials are selected from the group consisting of polycyclic aromatic ring, a nitrogen-containing hetero ring, triazines, indolocarbazoles, carbazole, N-ethyl carbazole, N-isopropyl carbazole, N-phenyl carbazole, tetraphenylpyrene, 1-methyl pyrene, perylene, clrysene, anthracene, tetraphene, 2-phenyl naphthalene, azopyrene, 1-ethyl pyrene, acetyl pyrene, 2,3-benzoclirysene, 2,4-benzopyrene, 1,4-bromopyrene, poly(N-vinylcarbazole), poly(vinylpyrene), poly(vinyltetraphene), poly(vinyltetracene), poly(vinylperylene), 2,4,7-trinitro-9-fluorenone, 2,4,5,7-tetranitro-fluorenone, dinitroantliracene, dinitroacridene, tetracyanopyrene, dinitroanthraquinone, butylcarbonylfluorenemalononitrile, arylamines, and mixtures thereof.

19. The photoreceptor device according to claim 11, wherein the charge transport layer further includes a binder.

20. The photoreceptor device according to claim 19, wherein the binder is capable of forming a self-assembled patterned layer.

* * * * *